US006293079B1

(12) United States Patent
Heinzle et al.

(10) Patent No.: US 6,293,079 B1
(45) Date of Patent: Sep. 25, 2001

(54) HOLLOW SPINDLE, IN PARTICULAR FOR THE MANUFACTURE OF ELASTIC TWISTED YARNS

(75) Inventors: Norbert Heinzle, Wolfurt; Hansjoerg Dür, Schwarzach, both of (AT)

(73) Assignee: Hamel AG, Arbon (CH)

( * ) Notice: Subject to any disclaimer, the term of this patent is extended or adjusted under 35 U.S.C. 154(b) by 0 days.

(21) Appl. No.: 09/552,349

(22) Filed: Apr. 19, 2000

(30) Foreign Application Priority Data

Apr. 28, 1999 (DE) ..... 199 19 232

(51) Int. Cl.[7] ..... D01H 7/04
(52) U.S. Cl. ..... 57/129; 57/135
(58) Field of Search ..... 57/129, 132, 134, 57/135

(56) References Cited

U.S. PATENT DOCUMENTS 3,122,877 * 3/1964 Keyser ..... 57/129
3,948,032 4/1976 Quast .
4,736,579 * 4/1988 Stenmans ..... 57/129
5,404,703 4/1995 Frentzel-Beyme et al. .

FOREIGN PATENT DOCUMENTS 200 628 10/1938 (CH) .
29 19 100 11/1980 (DE) .
196 26 549 1/1998 (DE) .

* cited by examiner

*Primary Examiner*—Danny Worrell
(74) *Attorney, Agent, or Firm*—Flynn, Thiel, Boutell & Tanis, P.C.

(57) ABSTRACT

A hollow spindle, in particular for the manufacture of elastic twisted yarns, has a thread channel (9) extending coaxially with respect to the axis of the spindle (A), through which thread channel is axially moved a yarn (6), in particular an elastic core yarn. The thread channel (9) has ribs (10) on its inner surface (8*a*), which extend in peripheral direction or helically and project inwardly over the surface (8*a*), so that the yarn (6) running through the thread channel (9) rests only pointlike on the ribs, otherwise, however, is supported at a distance from the inner surface (8*a*).

13 Claims, 2 Drawing Sheets

A
F
5
4
1
II
8
9
7
2
3
6

HOLLOW SPINDLE, IN PARTICULAR FOR THE MANUFACTURE OF ELASTIC TWISTED YARNS

FIELD OF THE INVENTION

The invention relates to a hollow spindle, in particular for the manufacture of elastic twisted yarns, comprising a thread channel extending coaxially with respect to the axis of the spindle, through which thread channel is axially moved a yarn, in particular an elastic core yarn.

BACKGROUND OF THE INVENTION

When manufacturing elastic twisted yarns with hollow spindles, as they are known, for example, from the DE 29 19 100 C2, DE 196 26 549 A1 or CH 200 628, the troublefree processing of the yarn is important for the economic efficiency and the quality of the finished product. Critical in these processes is the running behaviour of the elastic core yarn, for example Elastan. In particular when using fine core yarns (44 dtex, 22 dtex, 11 dtex or even finer yet), utilizing Elastan, and there most of all at low drafts (less than 3 times), breakdowns of many different types occur because of the low yarn tensions, which breakdowns can result in breakage of the yarn. The yarn tension of the core yarn from the point of removal from the feed bobbin to the point at which it is twisted above the exit from the hollow spindle is therefore a very important parameter. The behaviour of the core yarn in the thread channel of the hollow spindle has a decisive influence on the yarn tension. As a rule one must assume that the core yarn rests on the inner surface of the thread channel and rotates together with the hollow spindle. Until now the thread channel in the hollow spindle is created by means of a long bore. Thus the surface of the thread channel is cylindrical. A cylindrical surface contacts the core yarn along a contact line, which in particular due to the characteristics of the elastic core yarn results in a large amount of friction. This friction reduces the tension in the core yarn, which it has prior to entering the hollow spindle, which can lead to the abovedisclosed breakdowns. In the case of many types of yarns, in particular Elastan, an adhering effect also occurs between the yarn and the smooth surfaces of the thread channel, which can clearly further increase the friction force.

SUMMARY OF THE INVENTION

The basic purpose of the invention is to provide a hollow spindle, in particular for the manufacture of elastic twisted yarns, in which the friction between the inner surface of the thread channel and the core yarn is reduced to a minimum and thus a trouble free processing of the yarn is guaranteed.

This is attained according to the invention in such a manner that the thread channel has ribs on its inner surface, which ribs extend in peripheral direction or helically, and project inwardly over the surface so that the yarn running through the thread channel contacts the ribs at a point thereon, otherwise, however, the yarn is supported at a distance from the inner surface.

Since the yarn running through the thread channel has in this embodiment only a pointlike contact with the ribs, the friction between thread channel and yarn is very significantly reduced. The friction created in the thread channel can thus no longer or only very insignificantly influence the intended yarn tension of the core yarn. The trouble free processing is thus guaranteed also in the case of very low yarn tensions.

In order to reduce the number of pointlike contact areas between the ribs and the yarn guided through the thread channel, the ribs should advantageously be arranged at large axial distances from one another.

An advantageous embodiment of the hollow spindle is that the thread channel is formed by a small tube inserted into a center bore of the hollow spindle, which small tube has the ribs on its inner surface. Such a small tube provided with ribs can namely be manufactured relatively inexpensively, and it is in addition possible to optimize the inner surface of the small tube, namely of the inwardly projecting ribs, in order to reduce the initially mentioned adhering effect.

The inner surface of the small tube should for this purpose be thread-fine. The term "thread-fine" refers to a surface which does not rough up the thread. The surface is thereby not to be smooth because this creates a sticky effect, but it is to be matted or similar to a very fine orange skin. Such a surface can be achieved during a drawing of the small tube or also its deformation, which occurs in order to create the ribs.

Further advantageous embodiments of the invention are characterized in the remaining subclaims.

BRIEF DESCRIPTION OF THE DRAWINGS

The invention will be discussed in greater detail hereinafter in connection with exemplary embodiments illustrated in the drawings, in which.

DETAILED DESCRIPTION

Figure 1:
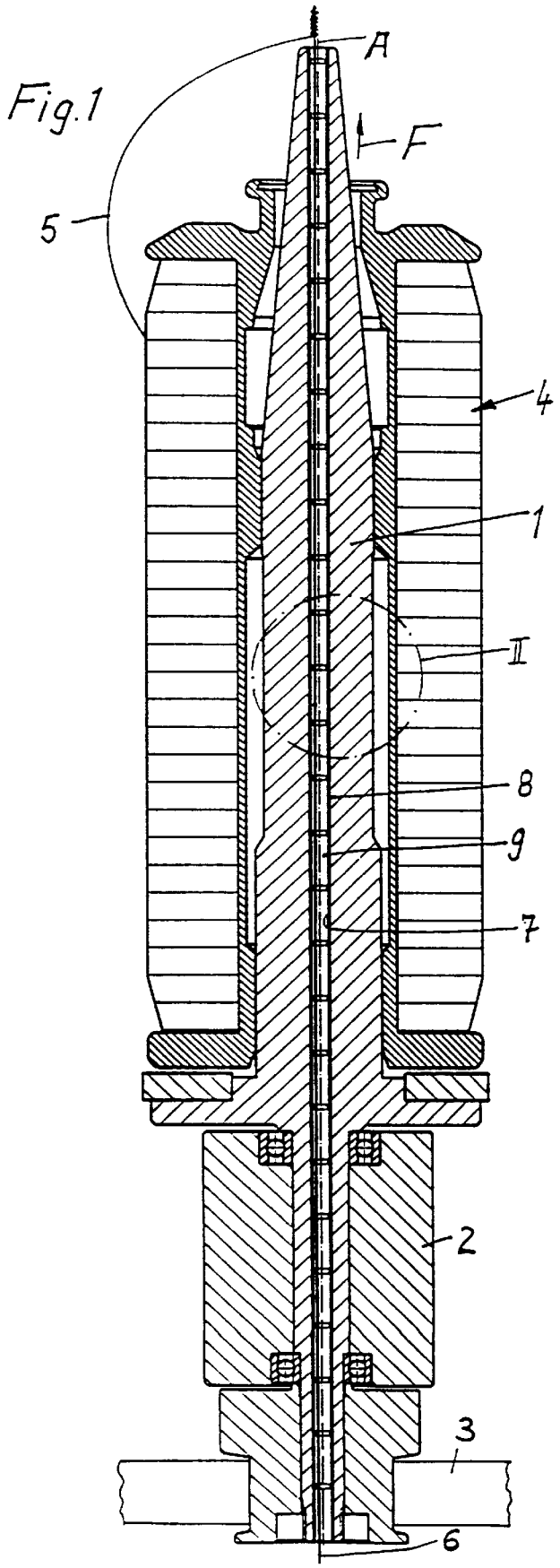
FIG. 1 is an axial cross-sectional view of a hollow spindle for the manufacture of twisted yarns.

FIG. 1 illustrates a hollow spindle for the manufacture of an elastic twisted yarn of the usual type. The hollow spindle 1 is rotatably supported on the spindle support 2 and is rotated by means of a drive belt 3, which simultaneously drives a larger number of spindles. A feed bobbin 4 is mounted on the spindle 1, which feed bobbin carries the twisted yarn 5. The core yarn is rolled off from a further, not illustrated feed bobbin and is pulled under tension from below upwardly through the hollow spindle 1.

The hollow spindle 1 has for this purpose a thread channel 9 extending coaxially with respect to the spindle axis A, which thread channel is advantageously formed by a small tube 8 inserted into a center bore 7 of the hollow spindle 1.

Figure 3:
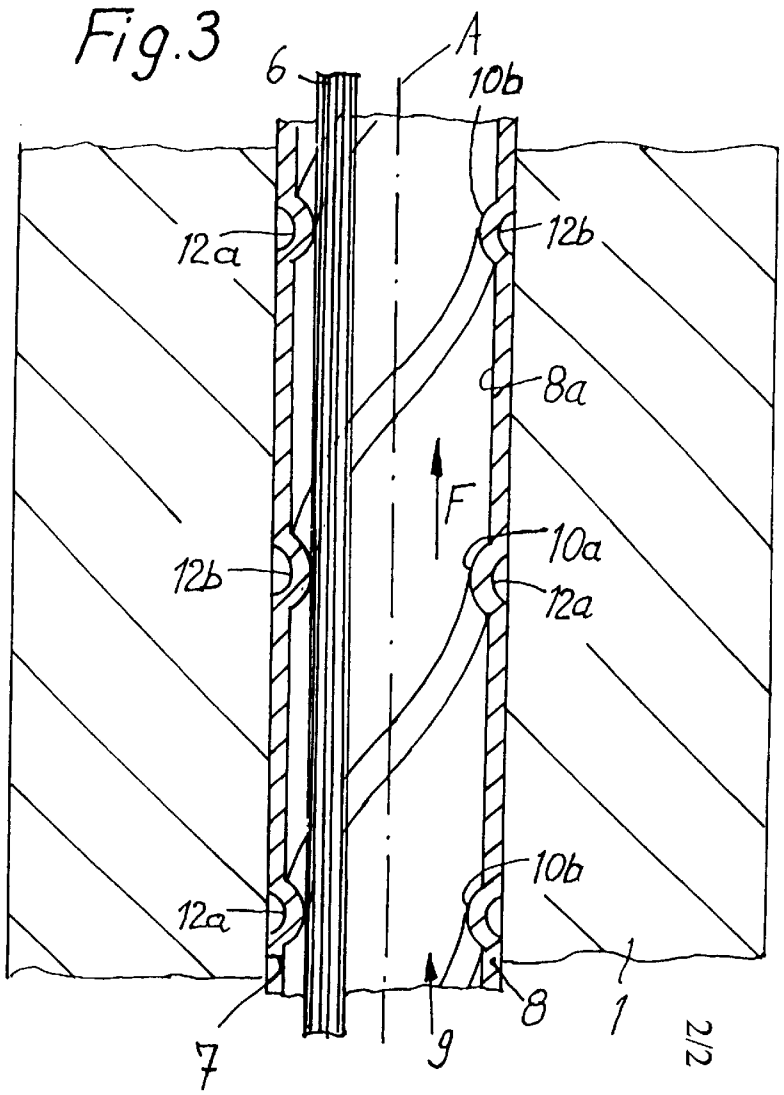
FIG. 3 illustrates a second embodiment, also in an enlarged scale.
Figure 2:
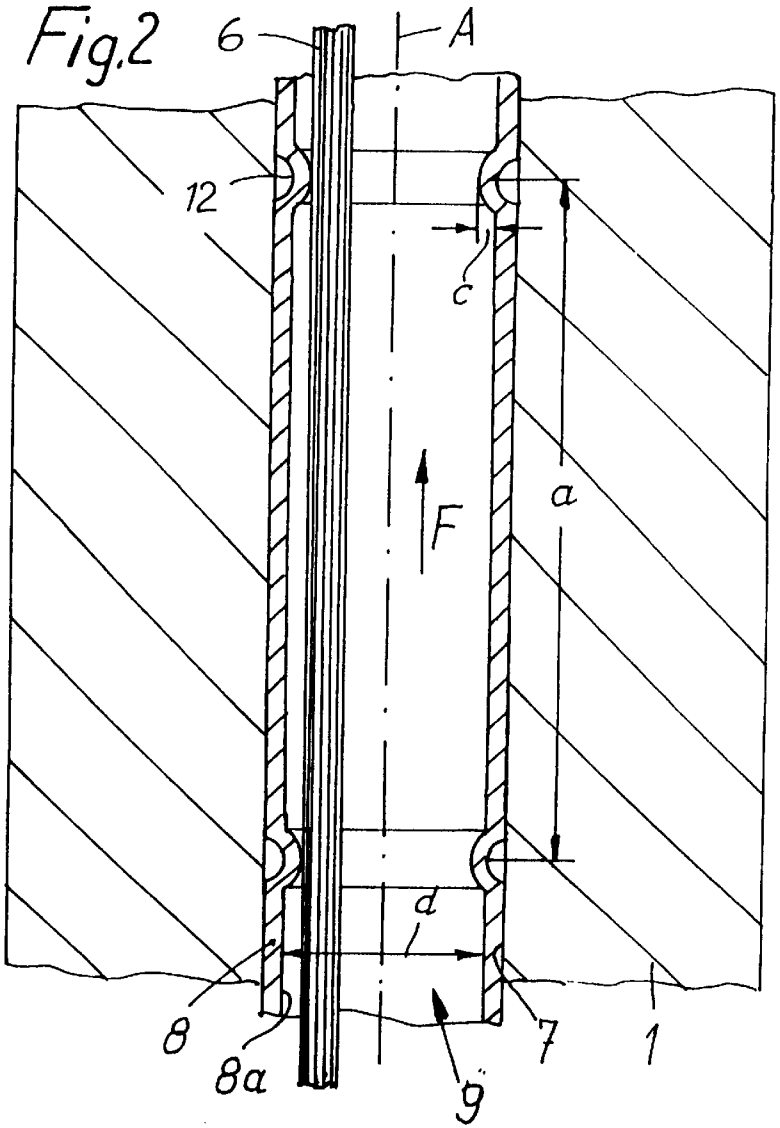
FIG. 2 is a cutaway portion of the area II of FIG. 1 in an enlarged scale.

The exact design of this small tube 8 can be recognized in FIGS. 2 or 3.

The small tube 8 has in the embodiment illustrated in FIG. 2 several ribs 10 extending in peripheral direction and projecting inwardly over the inner surface of the small tube. The ribs 10 are arranged at large axial distances a from one another. At an inside diameter d of the small tube 8 of, for example, 6 mm, it is possible for the ribs 10 to be arranged at axial distances a of approximately 20 mm from one another. The ribs 10 project hereby radially inwardly at an amount c of approximately 0.5 mm over the inner surface 8*a*. The amount c and the distances a must be adjusted to one another in such a manner that the core yarn 6 rests only at points on the ribs 10, however, are otherwise held at a distance from the inner surface 8*a*.

The ribs 10*a*, 10*b* are arranged helically, that is in the form of a double helix, namely the helix 10*a* and the helix 10*b*, in the exemplary embodiment illustrated in FIG. 3. With respect to the dimensions a and c, the discussions in relationship to FIG. 2 are analogously valid.

The ribs 10, 10*a*, 10*b* are advantageously formed through a plastic deformation of the wall of the small tube. This is done in such a manner that the ribs are formed by groovelike impressions 12, 12*a*, 12*b* in the outer surface of the small tube, which impressions extend in peripheral direction (FIG. 2) or helically (FIG. 3). The groovelike impressions 12, 12*a*, 12*b* in the wall of the small tube form then the ribs 10, 10*a*, 10*b* projecting radially inwardly from the inner surface.

In order to guarantee on the one hand a bearing of the core yarn 6 on the ribs 10, 10*a*, 10*b*, which bearing is as pointlike as possible, and in order to avoid on the other hand also a damage to the core yarn when same runs in axial direction through the thread channel 9, the surface of the ribs should be rounded in the thread running direction F.

The small tube 8 consists advantageously of metal, namely advantageously of brass or a rust-free steel. More detailed information regarding the surface structure of the inner surface of the small tube have already been set forth above.

The inwardly projecting ribs 10, 10*a*, 10*b* have initially the advantage that the core yarn 6 has at all times only a pointlike contact with the ribs 10, 10*a*, 10*b*, is otherwise, however, spaced from the inner wall 8*a* of the small tube. In this manner it is possible to very significantly reduce the friction between the core yarn 6 and the thread channel 9. It is also suspected that because of the design of the ribs 10, 10*a*, 10*b* and the relative movement of the core yarn 6 with respect to the ribs, an air cushion is built up near the inner surface 8*a*, which holds the core yarn in the center of the small tube 8 and thus prevents contact or at least reduces the friction.

The use of the described small tubes does not increase the manufacturing costs of the hollow spindle. Namely, it is possible to create the long bore 7 during a drilling of the spindle 1 since no consideration must be given to the interior surface of the long bore. The time saved with this form of drilling balances the expense of the manufacture and installation of the small tube.

What is claimed is:

1. A hollow spindle for the manufacture of elastic twisted yarns, comprising a thread channel extending coaxially with respect to a spindle axis, through which thread channel is axially moved an elastic core yarn, wherein the thread channel has ribs on its inner surface, which ribs extend in a peripheral direction and project radially inwardly over the surface, so that the yarn running through the thread channel engages radially inward tips of the ribs so as to be supported at a distance from the inner surface.

2. The hollow spindle according to claim 1, wherein the ribs are arranged at large axial distances (a) of approximately 20 mm from one another.

3. The hollow spindle according to claim 1, wherein the thread channel is formed by a small tube inserted into a central bore of the hollow spindle, which small tube has the ribs on its inner surface.

4. The hollow spindle according to claim 3, wherein the ribs are formed by plastic deformation of the wall of the small tube.

5. The hollow spindle according to claim 4, wherein the ribs are formed by groovelike impressions in the outer surface of the small tube, which impressions extend in peripheral direction or helically.

6. The hollow spindle according to claim 3, wherein the small tube consists of metal.

7. The hollow spindle according to claim 6, wherein the small tube consists of brass.

8. The hollow spindle according to claim 6, wherein the small tube consists of a rust-free steel.

9. The hollow spindle according to claim 1, wherein the inner surface of the small tube is matted.

10. The hollow spindle according to claim 1, wherein the inner surface of the small tube is designed similarly to a very fine orange skin.

11. The hollow spindle according to claim 1, wherein the ribs project approximately 0.5 mm beyond the surface lying therebetween.

12. The hollow spindle according to claim 1, wherein the surface of the ribs is rounded in thread running direction.

13. The hollow spindle according to claim 1, wherein the peripheral direction is a helical direction.

* * * * *